US005903952A

United States Patent [19]

Camp, Jr. et al.

[11] Patent Number: 5,903,952

[45] Date of Patent: May 18, 1999

[54] INDEXABLE PAINT ROLLER FRAME

[75] Inventors: William P. Camp, Jr.; Gary Leisure, both of Wooster, Ohio

[73] Assignee: The Wooster Brush Company, Wooster, Ohio

[21] Appl. No.: 08/874,620

[22] Filed: Jun. 13, 1997

[51] Int. Cl.[6] ..... B05C 17/02

[52] U.S. Cl. ..... 15/230.11; 15/144.1; 492/13; 492/19

[58] Field of Search ..... 15/144.1, 230.11; 492/13, 19; 403/92, 93, 96, 103, 325

[56] References Cited

U.S. PATENT DOCUMENTS

| | | | |
|---|---|---|---|
| 2,841,810 | 7/1958 | Reinhard . | |
| 3,273,192 | 9/1966 | Mazzella . | |
| 3,419,931 | 1/1969 | Willig . | |
| 3,984,892 | 10/1976 | Kyriakou . | |
| 4,237,575 | 12/1980 | Mlachnik . | |
| 4,370,773 | 2/1983 | Hadary . | |
| 4,528,714 | 7/1985 | Beck . | |
| 5,207,755 | 5/1993 | Ampian . | |
| 5,386,611 | 2/1995 | Kim . | |
| 5,410,773 | 5/1995 | Forkner | 15/230.11 |

FOREIGN PATENT DOCUMENTS

| | | | |
|---|---|---|---|
| 1190520 | 7/1985 | Canada | 15/230.11 |

*Primary Examiner*—Randall E. Chin

*Attorney, Agent, or Firm*—Renner, Otto, Boisselle & Sklar, P.L.L.

[57] ABSTRACT

A paint roller frame includes a handle having a radial bore and a wire shank having an outer end for rotatably supporting a paint roller cover and an inner end rotatably received in the bore. The outer end of the wire shank extends at an angle relative to the inner end whereby turning movement of the inner end within the bore will cause a change in the orientation of the outer end and thus the paint roller cover supported thereby relative to the handle. Between the inner and outer ends of the wire shank is an intermediate portion including a radial leg extending at a right angle relative to the inner end which is spring biased into engagement with any one of a plurality of notches in an end wall of the handle surrounding the bore for retaining the outer end of the wire shank in any one of a plurality of different orientations relative to the handle. A pushing force applied to a button or the innermost end of the wire shank will cause the radial leg of the intermediate portion to move out of engagement with any one of the notches thus permitting the inner end of the wire shank to be turned within the bore to change the orientation of the outer end relative to the handle.

37 Claims, 2 Drawing Sheets

INDEXABLE PAINT ROLLER FRAME

FIELD OF THE INVENTION

This invention relates generally to a paint roller frame which is indexable to several different positions to permit the paint roller cover supported thereby to reach difficult faces and angles of a painting surface such as railings, cabinets, pipes, trim and the like.

BACKGROUND OF THE INVENTION

It is generally known to provide an adjustable connection between the handle and shank portion of a paint roller frame that will permit the paint roller cover to be positioned at a desired angular relationship to the handle so that the user doesn't have to hold the frame at an uncomfortable angle when painting angled surfaces. However, oftentimes it is difficult and time consuming to make such angular adjustments. Also, oftentimes the adjustable connection and shape of the shank portion will not allow the roller cover to be used to paint between and behind areas of a painting surface such as railings, cabinets, pipes and trim where there is narrow access.

SUMMARY OF THE INVENTION

In accordance with one aspect of the present invention, a paint roller frame is provided in which the paint roller cover can easily be indexed to several different positions relative to the handle whenever desired for painting surfaces with different angles and narrow access such as railings, cabinets, pipes, trim and the like.

In accordance with another aspect of the invention, the shank which supports the paint roller cover is securely held in any desired adjusted position and yet the position of the shank can easily be changed at any time.

In accordance with another aspect of the invention, the shank is indexable about an axis to any one of a plurality of positions facing in different directions over 360°.

In accordance with another aspect of the invention, a spring mechanism releasably retains the shank in any desired adjusted position.

In accordance with another aspect of the invention, the spring mechanism is concealed from view and protected from paint splatter.

In accordance with another aspect of the invention, the paint roller frame is economical to manufacture and can be folded into a compact package in which the outer portion of the shank that rotatably supports the roller cover overlies the handle in closely spaced relation to allow the frame to easily fit into a paint tray or shell and minimize the space requirements for mounting or displaying the frame on a merchandiser or the like.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
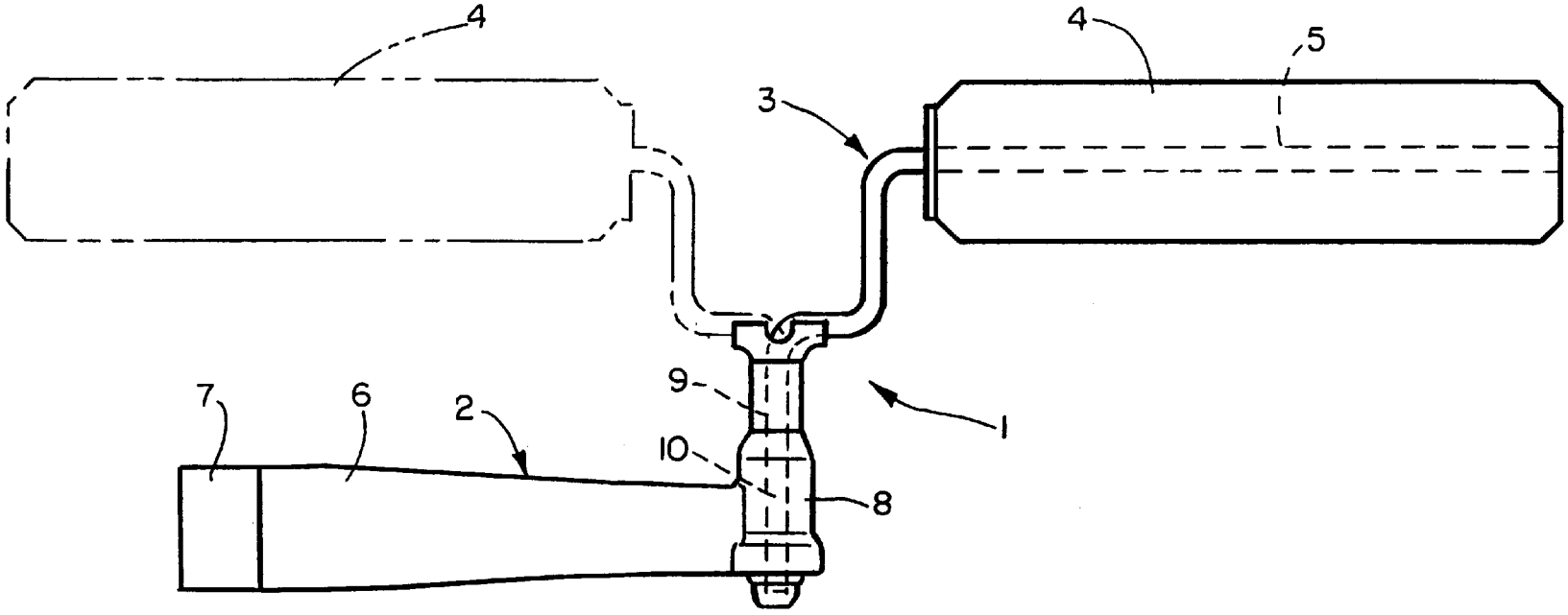
FIG. 1 is a side elevation view of a preferred form of paint roller frame in accordance with the present invention.
Figure 2:
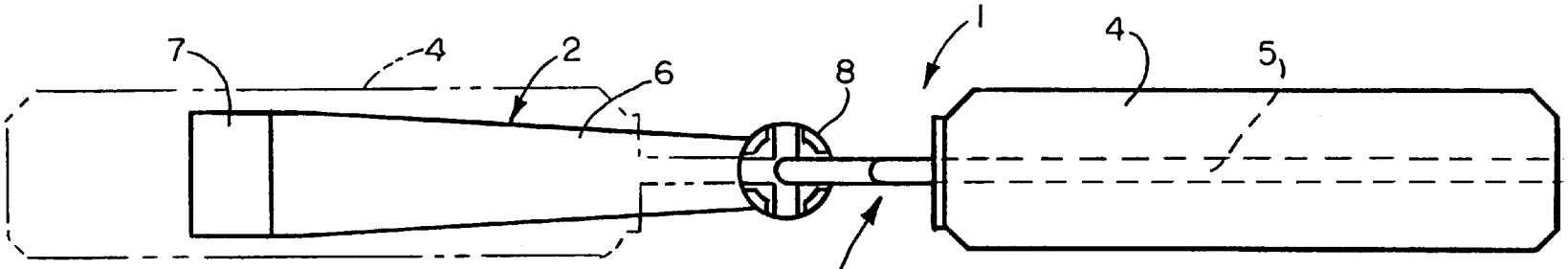
FIG. 2 is a top plan view of the paint roller frame of FIG. 1.
Figure 3:
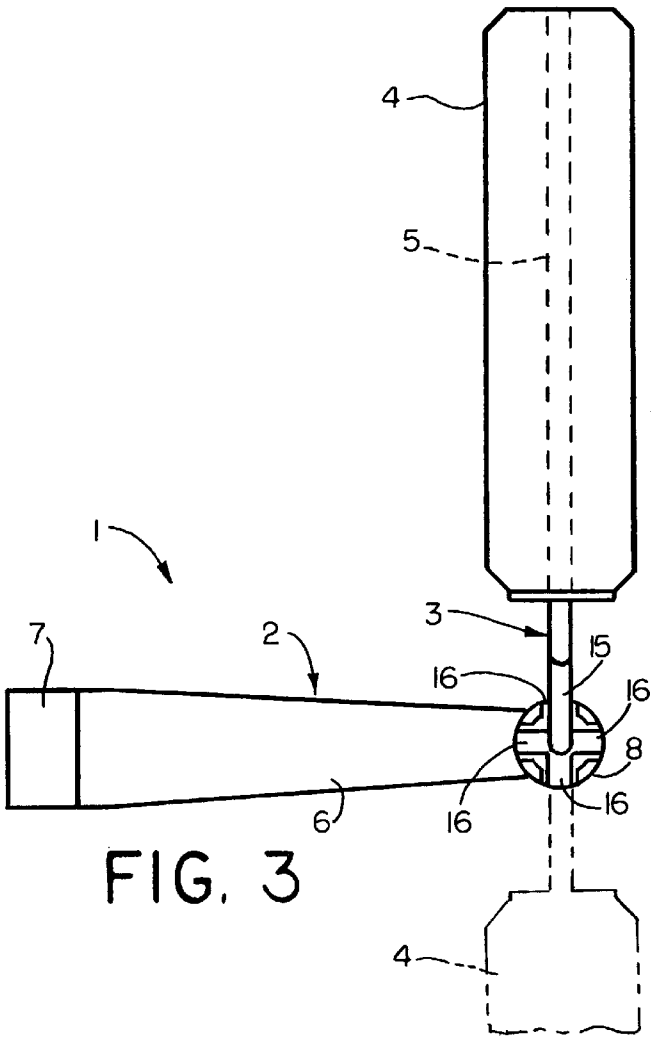
FIG. 3 is a top plan view of the paint roller frame similar to FIG. 2 but showing the outer shank portion on which the paint roller cover is rotatably supported oriented in a different position 90° to that shown in FIG. 2.

Referring now in detail to the drawings, and initially to FIGS. 1 through 3, there is shown a preferred form of paint roller frame 1 in accordance with this invention including a handle 2 and wire shank 3 connected thereto for supporting a paint roller cover 4. As described in greater detail hereafter, the shank 3 is indexable relative to the handle 2 to permit the roller cover to be oriented in different positions relative to the handle in order to permit the roller cover to be used to reach difficult faces and angles of a painting surface and also between and behind areas of a painting surface such as railings, cabinets, columns, pipes, trim and the like. Of course, when used for that purpose, the paint roller cover must be of a size that allows access of the roller cover to relatively narrow spaces. To that end, the roller cover may have a core diameter for example of approximately one-half inch and a length of approximately six and one-half inches. Also, the roller cover may have nap heights ranging for example from one-quarter to one-half inch. However, it will be apparent that the roller frame can be designed to accommodate roller covers having other core diameters and lengths as well as other nap heights if desired.

The roller cover 4 slides over the outer end 5 of the shank 3 and may be removably held in place in any suitable manner.

The frame handle 2 includes a hand grip 6 which may have a threaded adaptor 7 press fitted into the outer end thereof to permit the frame to be used with all standard threaded extension poles. Also, if desired, the adaptor 7 may be provided with a larger diameter non-circular recess adjacent its outer end for establishing an anti-rotation connection with a quick release lock mechanism of the type disclosed, for example, in U.S. Pat. No. 5,288,161 assigned to the same assignee as the present invention, the disclosure of which is incorporated herein by reference.

Figure 5:
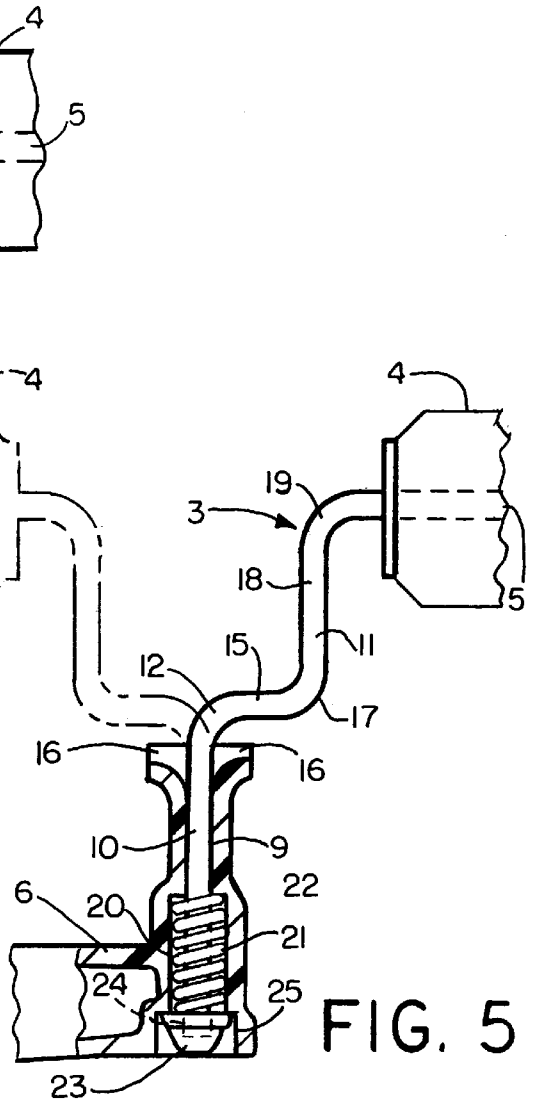
FIG. 5 is a fragmentary longitudinal section through the frame handle similar to FIG. 4 but showing the shank in an unlocked condition permitting the shank to be rotated in either direction about its center axis for positioning the outer shank portion in any one of a plurality of discrete positions facing in different directions over 360°.
Figure 4:
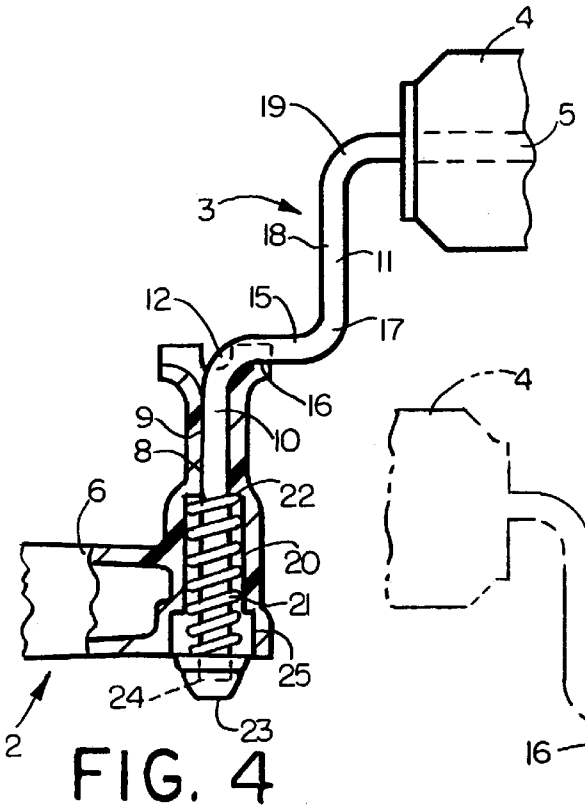
FIG. 4 is an enlarged fragmentary longitudinal section through the paint roller frame handle of FIG. 1 showing the mechanism for releasably retaining the outer shank portion in any one of a plurality of discrete positions facing in different directions over 360°.

At the inner end of the handle 2 is a body portion 8 which as best seen in FIGS. 4 and 5 extends radially outwardly from the hand grip 6 and contains a radial bore 9 through which the inner end 10 of the wire shank 3 extends. Preferably the hand grip 6 and body portion 8 are integrally molded as one piece out of a suitable plastic such as polypropylene that is impervious to most solvents, even after prolonged soaking.

The intermediate portion 11 of the wire shank 3 (e.g., the portion intermediate the outer and inner end portions 5 and 10) has three right angle bends giving the shank an overall generally S-shape configuration. One of the right angle bends 12 is adjacent the outer end of the radial body portion 8 and joins the inner shank portion 10 to a radial leg 15 of the intermediate portion 11. This radial leg 15 is selectively engageable in any one of a plurality of circumferentially spaced radially extending notches or grooves 16 in the body portion 8 surrounding the outer end of the bore 9 as described hereafter. At the outer end of the radial leg 15 is another one of the right angle bends 17 that joins the radial leg 15 to an axial leg 18 of the intermediate portion 11 extending generally parallel to the axis of the radial bore 9. At the outer end of the axial leg 18 is the third right angle bend 19 that extends further radially outwardly relative to the axis of the bore 9 in the body portion 8 and joins the outer end of the axial leg 18 to the outer end 5 of the shank 3 on which the roller cover 4 is rotatably mounted.

Within the handle body portion 8 is a counterbore 20 containing a compression spring 21 through which a portion of the inner end 10 of the wire shank 3 extends. The spring 21 is captivated between a shoulder 22 at the inner end of the counterbore 20 and a button 23 press fitted onto the innermost end 24 of the shank, whereby the spring urges the radial leg 15 of the intermediate portion 11 into engagement with one of the notches 16 in the radial outer end of the handle body 8. The inner end 10 of the shank 3 has a length sufficiently greater than the length of the handle body 8 to permit the button 23 to be press fitted onto the innermost end thereof. A recess 25 in the inner end of the body 8 in coaxial alignment with the counterbore 20 receives the button 23 when the button is pushed inwardly against the force of the spring 21. The recess 25 has a diameter only slightly greater than the diameter of the button 23 whereby the button 23 hides the spring 21 and shank inner end 10 from view and also keeps paint spatter and the like from getting into the recess and onto the spring.

The orientation or position of the outer end 5 of the wire shank 3 and thus the roller cover 4 supported thereby relative to the handle 2 can easily be changed at any time simply by pushing the spring loaded button 23 inwardly into the recess 25 at the inner end of the body with the user's thumb a sufficient distance to disengage the radial leg 15 of the intermediate shank portion 11 from one of the notches or grooves 16 in the outer end of the body as schematically shown in FIG. 5. This allows the radial leg 15 to be gently turned in either direction about its inner end 10 to any one of several discrete positions in overlying relation to any one of the notches 16. When the pushing force on the button 23 is released, the spring 21 will once again move the radial leg 15 of the intermediate shank portion 11 into an associated notch 16 to positively lock the shank 3 in any desired indexed position securely holding the roller cover 4 in place during use.

Although the number and angular spacing of the notches 16 in the radial outer end of the handle body 8 may be varied as desired, in the preferred embodiment disclosed herein, four such notches 16 are provided, each spaced substantially 90° apart around the periphery of the bore 9. Two of the notches 16 desirably extend in opposite directions in axial alignment with the longitudinal axis of the handle 2 as schematically shown in FIGS. 2 and 3, whereas the other two notches 16 desirably extend in opposite directions substantially perpendicular to the axis of the handle as also schematically shown in FIGS. 2 and 3. This permits the outer end 5 of the wire shank 3 on which the roller cover 4 is mounted to be indexed to four different positions with respect to the longitudinal axis of the handle 2, as follows:

1. Extending axially forward in parallel spaced relation to the axis of the handle as shown in solid lines in FIGS. 1, 2, 4 and 5;

2. Extending axially toward the rear in parallel relation to the axis of the handle as shown in phantom lines in FIGS. 1, 2 and 5;

3. Extending substantially perpendicular to the axis of the handle in one direction (e.g., to the left as viewed from the rear of the handle) radially spaced therefrom as shown in solid lines in FIG. 3; and 4. Extending substantially perpendicular to the axis of the handle in the opposite direction (e.g., to the right) radially spaced therefrom as shown in phantom lines in FIG. 3.

It has generally been found that these four positions are all that are necessary to permit the paint roller frame 1 of the present invention to be used as a multi-purpose tool for painting flat surfaces as well as surfaces with many different angles and narrow access including railings, cabinets, pipes, columns and trim, to name a few.

Also, the ability to index the frame 1 so that the outer shank portion 5 and associated roller cover 4 extend to the rear in overlying parallel spaced relation to the hand grip 6 as shown in phantom lines in FIGS. 1, 2 and 5 provides several versatile merchandising possibilities in that this particular orientation of the wire shank relative to the handle requires very little room for mounting of the frame on a peg board of a merchandiser or the like. In one form of the invention, when the frame 1 is thus indexed/folded with the outer shank portion 5 and roller cover 4 extending to the rear back over the hand grip 6, the frame measures approximately five inches wide from the shank to the grip. When laid flat in this position, the frame will also easily fit into a paint tray or shelf.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A paint roller frame comprising a handle having a longitudinal axis, a radial bore in said handle, and a shank portion having an outer end for rotatably supporting a paint roller cover and an inner end rotatably mounted within said radial bore in said handle, said outer end extending at an angle relative to said inner end, whereby turning of said inner end in said bore will cause changes in the orientation of said outer end and thus a roller cover rotatably supported on said outer end relative to said handle said outer end being movable in a plane radially outwardly spaced from said longitudinal axis of said handle.

2. The frame of claim 1 wherein said handle includes a radially outwardly extending body portion containing said radial bore, said body portion having an outer end with notches extending radially outwardly from said bore, and said shank portion including an intermediate portion between said inner and outer ends extending radially outwardly from said inner end which is engageable in any one of said notches for retaining said shank portion against movement relative to said handle.

3. The frame of claim 2 further comprising spring means for biasing said intermediate portion into engagement with any one of said notches.

4. The frame of claim 3 wherein said spring means is received in a counterbore in said body portion through which said inner end of said shank portion extends.

5. The frame of claim 4 wherein said spring means is captivated between a shoulder at an inner end of said counterbore and a button on an innermost end of said shank portion.

6. The frame of claim 5 further comprising a recess in an outer end of said body portion in coaxial alignment with said counterbore for receiving said button upon pushing said button inwardly against the bias of said spring means to disengage said intermediate portion of said shank portion from any one of said notches to permit said outer end of said shank portion to be indexed to different positions relative to said handle.

7. The frame of claim 2 wherein said shank portion includes a second intermediate portion at an outer end of said intermediate portion extending substantially parallel to the axis of said bore, said second intermediate portion having right angle bends at opposite ends joining opposite ends of said second intermediate portion to said intermediate portion and to said outer end of said shank portion, respectively.

8. The frame of claim 7 wherein said outer end of said shank portion extends in the same general direction as said intermediate portion in radially outwardly spaced relation therefrom.

9. The frame of claim 2 wherein four of said notches are provided in said outer end of said body portion, two of said notches extending generally parallel to a longitudinal axis of said handle in radial spaced relation therefrom, and another two of said notches extending generally perpendicular to the longitudinal axis of said handle in radial spaced relation therefrom.

10. The frame of claim 1 wherein said shank portion has a generally S-shape configuration formed by three right angle bends intermediate said inner and outer ends of said shank portion joining said inner and outer ends together.

11. An indexable paint roller frame comprising a handle having a longitudinal axis, a radial bore in said handle, and a wire shank having an outer end for rotatably supporting a paint roller cover and an inner end rotatably received in said bore in said handle, said outer end extending at an angle relative to said inner end whereby turning of said inner end within said bore will cause a change in the orientation of said outer end and thus a roller cover rotatably supported on said outer end relative to said handle said outer end being movable in a plane radially outwardly spaced from said longitudinal axis of said handle.

12. The frame of claim 11 wherein said outer end of said wire shank is movable upon turning said inner end within said bore over 360° in a plane radially outwardly spaced from a longitudinal axis of said handle.

13. The frame of claim 12 wherein the radial spacing between said outer end of said wire shank and said handle is sufficient to permit a roller cover on said outer end of said wire shank to clear said handle when said outer end is rotated to a position overlying said handle.

14. The frame of claim 11 wherein said wire shank includes an intermediate portion between said inner and outer ends which is engageable in any one of a plurality of notches in an end wall of said handle surrounding said bore.

15. The frame of claim 14 further comprising a spring for biasing said intermediate portion of said wire shank into any one of said notches for retaining said outer end of said wire shank in any one of a plurality of different orientations relative to said handle.

16. The frame of claim 15 wherein said spring is received in a counterbore in said handle coaxial with said bore, said inner end of said wire shank extending through said spring.

17. The frame of claim 16 wherein said spring is captivated between a shoulder at an inner end of said counterbore and a button on an innermost end of said wire shank, whereby upon application of a pushing force to said button, said intermediate portion of said wire shank will move out of engagement with any one of said notches thus permitting said inner end of said wire shank to be turned within said bore to change the orientation of said outer end of said wire shank relative to said handle.

18. The frame of claim 14 wherein said inner end of said wire shank is rotatable within said bore for orienting said outer end of said wire shank over 360° relative to said handle.

19. The frame of claim 14 wherein said end wall of said handle includes a first pair of said notches in line with a longitudinal axis of said handle on opposite sides of said bore for orienting said outer end of said wire shank so that said outer end extends forwardly or rearwardly relative to said handle in parallel radially spaced relation to the longitudinal axis of said handle when said intermediate portion of said wire shank is engaged in one or the other of said first pair of said notches.

20. The frame of claim 19 wherein said handle also includes a second pair of said notches extending generally perpendicular to said first pair of said notches on opposite sides of said bore for orienting said outer end of said wire shank so that said outer end extends generally perpendicular to the longtudinal axis of said handle in opposite directions when said intermediate portion of said wire shank is engaged in one or the other of said second pair of said notches.

21. A paint roller frame comprising a handle and a shank portion, a radial bore in said handle, said shank portion having an outer end for rotatably supporting a paint roller cover and an inner end rotatably mounted within said radial bore in said handle, said outer end extending at an angle relative to said inner end, whereby turning of said inner end in said bore will cause changes in the orientation of said outer end and thus a roller cover rotatably supported on said outer end relative to said handle, said handle including a radially outwardly extending body portion containing said radial bore, said body portion having an outer end with notches extending radially outwardly from said bore, and said shank portion including an intermediate portion between said inner and outer ends extending radially outwardly from said inner end which is engageable in any one of said notches for retaining said shank portion against movement relative to said handle.

22. The frame of claim 21 further comprising spring means for biasing said intermediate portion into engagement with any one of said notches.

23. The frame of claim 22 wherein said spring means is received in a counterbore in said body portion through which said inner end of said shank portion extends.

24. The frame of claim 23 wherein said spring means is captivated between a shoulder at an inner end of said counterbore and a button on an innermost end of said shank portion.

25. The frame of claim 24 further comprising a recess in an inner end of said body portion in coaxial alignment with said counterbore for receiving said button upon pushing said button inwardly against the bias of said spring means to disengage said intermediate portion of said shank portion from any one of said notches to permit said outer end of said shank portion to be indexed to different positions relative to said handle.

26. The frame of claim 21 wherein said shank portion includes a second intermediate portion at an outer end of said intermediate portion extending substantially parallel to a longitudinal axis of said bore, said second intermediate portion having right angle bends at opposite ends joining opposite ends of said second intermediate portion to said intermediate portion and to said outer end of said shank portion, respectively.

27. The frame of claim 26 wherein said outer end of said shank portion extends in the same general direction as said intermediate portion in radially outwardly spaced relation therefrom.

28. The frame of claim 21 wherein four of said notches are provided in said outer end of said body portion, two of said notches extending generally parallel to a longitudinal axis of said handle in radial spaced relation therefrom, and another two of said notches extending generally perpendicular to the longitudinal axis of said handle in radial spaced relation therefrom.

29. An indexable paint roller frame comprising a handle having a longitudinal axis, a radial bore in said handle, and a wire shank having an outer end for rotatably supporting a paint roller cover and an inner end rotatably received in said bore in said handle, said outer end extending at an angle of approximately 90° relative to said inner end whereby turning of said inner end within said bore will cause a change in the orientation of said outer end and thus a roller cover rotatably supported on said outer end relative to said handle, said outer end of said wire shank being movable upon turning said inner end within said bore over 360° in a plane radially outwardly spaced from said longitudinal axis of said handle.

30. The frame of claim 29 wherein the radial spacing between said outer end of said wire shank and said handle is sufficient to permit a roller cover on said outer end of said wire shank to clear said handle when said outer end is rotated to a position overlying said handle.

31. An indexable paint roller frame comprising a handle having a longitudinal axis, a radial bore in said handle, and a wire shank having an outer end for rotatably supporting a paint roller cover and an inner end rotatably received in said bore in said handle, said outer end extending at an angle of approximately 90° relative to said inner end whereby turning of said inner end within said bore will cause a change in the orientation of said outer end and thus a roller cover rotatably supported on said outer end relative to said handle, said handle including an end wall surrounding said bore containing a plurality of radial notches, and said wire shank including an intermediate portion between said inner and outer ends which is engageable in any one of said notches.

32. The frame of claim 31 further comprising a spring for biasing said intermediate portion of said wire shank into any one of said notches for retaining said outer end of said wire shank in any one of a plurality of different orientations relative to said handle.

33. The frame of claim 32 wherein said spring is received in a counterbore in said handle coaxial with said bore, said inner end of said wire shank extending through said spring.

34. The frame of claim 33 wherein said spring is captivated between a shoulder at an inner end of said counterbore and a button on an innermost end of said wire shank, whereby upon application of a pushing force to said button, said intermediate portion of said wire shank will move out of engagement with any one of said notches thus permitting said inner end of said wire shank to be turned within said bore to change the orientation of said outer end of said wire shank relative to said handle.

35. The frame of claim 31 wherein said inner end of said wire shank is rotatable within said bore for orienting said outer end of said wire shank over 360° relative to said handle.

36. The frame of claim 31 wherein said end wall of said handle includes a first pair of said notches in line with a longitudinal axis of said handle on opposite sides of said bore for orienting said outer end of said wire shank so that said outer end extends forwardly or rearwardly relative to said handle in parallel radially spaced relation to the longitudinal axis of said handle when said intermediate portion of said wire shank is engaged in one or the other of said first pair of said notches.

37. The frame of claim 36 wherein said handle also includes a second pair of said notches extending generally perpendicular to said first pair of said notches on opposite sides of said bore for orienting said outer end of said wire shank so that said outer end extends generally perpendicular to the longitudinal axis of said handle in opposite directions when said intermediate portion of said wire shank is engaged in one or the other of said second pair of said notches.

* * * * *